US005514230A

United States Patent [19]

Khandhadia

[11] Patent Number: 5,514,230

[45] Date of Patent: May 7, 1996

[54] NONAZIDE GAS GENERATING COMPOSITIONS WITH A BUILT-IN CATALYST

[75] Inventor: Paresh S. Khandhadia, Rochester Hills, Mich.

[73] Assignee: Automotive Systems Laboratory, Inc., Farmington Hills, Mich.

[21] Appl. No.: 421,948

[22] Filed: Apr. 14, 1995

[51] Int. Cl.[6] ..... C06B 47/08

[52] U.S. Cl. ..... 149/36; 149/61; 149/77

[58] Field of Search ..... 149/36, 61, 77

[56] References Cited

U.S. PATENT DOCUMENTS

| | | | |
|---|---|---|---|
| 1,511,771 | 10/1924 | Rathsburg . | |
| 2,981,616 | 4/1961 | Boyer | 149/35 |
| 3,004,959 | 10/1961 | Finnegan et al. | 260/88.3 |
| 3,055,911 | 9/1962 | Finnegan et al. | 260/308 |
| 3,171,249 | 3/1965 | Bell | 60/35.4 |
| 3,348,985 | 10/1967 | Stadler et al. | 149/2 |
| 3,468,730 | 9/1969 | Gawlick et al. | 149/61 |
| 3,719,604 | 3/1973 | Prior et al. | 252/186 |
| 3,734,789 | 5/1973 | Moy et al. | 149/19 |
| 3,739,574 | 6/1973 | Godfrey | 60/39.03 |
| 3,741,585 | 6/1973 | Hendrickson et al. | 280/150 AB |
| 3,814,694 | 6/1974 | Klager et al. | 252/186 |
| 3,873,477 | 3/1975 | Beck et al. | 260/2.5 R |
| 3,898,112 | 8/1975 | Strecker et al. | 149/19.9 |
| 3,904,221 | 9/1975 | Shiki et al. | 280/150 AB |
| 3,909,322 | 9/1975 | Chang et al. | 149/19.4 |
| 3,912,561 | 10/1975 | Doin et al. | 149/35 |
| 3,947,300 | 3/1976 | Passauer et al. | 149/35 |
| 3,954,528 | 5/1976 | Chang et al. | 149/19.4 |
| 4,203,787 | 5/1980 | Kirchoff et al. | 149/35 |
| 4,296,084 | 10/1981 | Adams et al. | 423/351 |
| 4,369,079 | 1/1983 | Shaw | 149/2 |
| 4,370,181 | 1/1983 | Lundstrom et al. | 149/2 |
| 4,376,002 | 3/1983 | Utracki | 149/35 |
| 4,547,235 | 10/1985 | Schneiter et al. | 149/35 |
| 4,865,667 | 9/1989 | Zeuner et al. | 149/22 |
| 4,931,112 | 6/1990 | Wardle et al. | 149/88 |
| 4,948,439 | 8/1990 | Poole et al. | 149/46 |
| 5,035,757 | 7/1991 | Poole | 149/46 |

*Primary Examiner*—Donald P. Walsh
*Assistant Examiner*—Anthony R. Chi
*Attorney, Agent, or Firm*—Lyman R. Lyon

[57] ABSTRACT

Nonazide gas generating compositions are formed from a nonazide fuel, an oxidizer, a slag former, and a built-in catalyst comprising an alkali metal, alkaline earth metal, or transition metal salt of tetrazoles, bitetrazoles, and triazoles, or a transition metal oxide. The built-in catalyst promotes the conversion of nitrogen oxides ($NO_x$) and carbon monoxide to nitrogen gas ($N_2$) and carbon dioxide, respectively. The gas generants are therefore nontoxic and useful for inflating a vehicle occupant restraint system.

5 Claims, No Drawings

NONAZIDE GAS GENERATING COMPOSITIONS WITH A BUILT-IN CATALYST

BACKGROUND OF THE INVENTION

The present invention relates generally to gas generating compositions used for inflating occupant safety restraints in motor vehicles, and more particularly to nonazide gas generants that produce combustion products having acceptable toxicity levels in the event of exposure to vehicle occupants.

Inflatable occupant restraint devices for motor vehicles have been under development worldwide for many years, including the development of gas generating compositions for inflating such occupant restraints. Because the inflating gases produced by the gas generants must meet strict toxicity requirements, most, if not all, gas generants now in use are based on alkali or alkaline earth metal azides, particularly sodium azide. When reacted with an oxidizing agent, sodium azide forms a relatively nontoxic gas consisting primarily of nitrogen. Moreover, combustion of azide-based gas generants occurs at relatively low temperatures, which allows for the production of nontoxic inflating gases without a need for additives to reduce the combustion temperature.

However, azide-based gas generants are inherently difficult to handle and entail relatively high risk in manufacture and disposal. Whereas the inflating gases produced by azide-based gas generants are relatively nontoxic, the metal azides themselves are conversely highly toxic, thereby resulting in extra expense and risk in gas generant manufacture, storage, and disposal. In addition to direct contamination of the environment, metal azides also readily react with acids and heavy metals to form extremely sensitive compounds that may spontaneously ignite or detonate.

In contradistinction, nonazide gas generants provide significant advantages over azide-based gas generants with respect to toxicity related hazards during manufacture and disposal. Moreover, most nonazide gas generant compositions typically supply a higher yield of gas (moles of gas per gram of gas generant) than conventional azide-based occupant restraint gas generants.

However, nonazide gas generants heretofore known and used produce unacceptably high levels of toxic substances upon combustion. The most difficult toxic gases to control are the various oxides of nitrogen ($NO_x$) and carbon monoxide (CO).

Reduction of the level of toxic $NO_x$ and CO upon combustion of nonazide gas generants has proven to be a difficult problem. For instance, manipulation of the oxidizer/fuel ratio only reduces either the $NO_x$ or CO. More specifically, increasing the ratio of oxidizer to fuel minimizes the CO content upon combustion because the extra oxygen oxidizes the CO to carbon dioxide. Unfortunately, however, this approach results in increased amounts of $NO_x$. Alternatively, if the oxidizer/fuel ratio is lowered to eliminate excess oxygen and reduce the amount of $NO_x$ produced, increased amounts of CO are produced.

The relatively high levels of $NO_x$ and CO produced upon combustion of nonazide gas generants, as opposed to azide-based gas generants, are due primarily to the relatively high combustion temperatures exhibited by nonazide gas generants. For example, the combustion temperature of a sodium azide/iron oxide gas generant is 969° C. (1776° F.), while the nonazide gas generants exhibit considerably higher combustion temperatures, such as 1818° C. (3304° F). Utilizing lower energy nonazide fuels to reduce the combustion temperature is ineffective because the lower energy nonazide fuels do not provide a sufficiently high gas generant burn rate for use in vehicle occupant restraint systems. The burn rate of the gas generant is important to ensure that the inflator will operate readily and properly.

Another disadvantage created by the high combustion temperatures exhibited by nonazide gas generants is the difficulty presented in forming solid combustion particles that readily coalesce into a slag. Slag formation is desirable because the slag is easily filtered, resulting in relatively clean inflating gases. In azide-based gas generants, the lower combustion temperatures are conducive to solid formation. However, many common solid combustion products which might be expected from nonazide gas generants are liquids at the higher combustion temperatures displayed by nonazide gas generants, and are therefore difficult to filter out of the gas stream.

Therefore, a need exists for a nonazide gas generant that can produce inflating gases in which toxic gases, such as $NO_x$ and CO, are minimized without compromising the desired burn rate of the gas generant.

SUMMARY OF THE INVENTION

The aforesaid problems are solved, in accordance with the present invention, by a nonazide gas generating composition which is nontoxic itself, and also produces inflating gases upon combustion which have reduced levels of $NO_x$ and CO. The manufacturing, storage, and disposal hazards associated with unfired azide inflators are eliminated by the gas generants of the invention. The reduced content of toxic gases produced upon combustion allow the gas generants of the present invention to be utilized in vehicle occupant restraint systems while protecting the occupants of the vehicle from exposure to toxic inflating gases, such as $NO_x$ and CO, which heretofore have been produced by nonazide gas generants.

Specifically, the present invention comprises a four component gas generant comprising a nonazide fuel, an oxidizer, a slag former and a built-in catalyst. The nonazide fuel is selected from the group consisting of tetrazoles, bitetrazoles and triazoles. The oxidizer is preferably selected from the group consisting of inorganic nitrates, chlorates, or perchlorates of alkali or alkaline earth metals. The slag forming compound is selected from alkali metal oxides, hydroxides, perchlorates, nitrates, chlorates, silicates, borates or carbonates, or from alkaline earth and transition metal hydroxides, perchlorates, nitrates, or chlorates, or from silicon dioxide, alkaline earth metal oxides, and naturally and synthetically manufactured magnesium and aluminum silicate compounds, such as naturally occurring or synthetically formulated clay and talc.

In accordance with the present invention, the built-in catalyst actively promotes the conversion of $NO_x$ and CO to nitrogen gas ($N_2$) and $CO_2$, respectively, so as to reduce the toxicity of the inflating gases produced by the gas generants. The built-in catalyst is selected from the group consisting of alkali metal, alkaline earth metal, and transition metal salts of tetrazoles, bitetrazoles, and triazoles, and transition metal oxides.

DETAILED DESCRIPTION OF THE PREFERRED EMBODIMENT(S)

In accordance with the present invention, the fuel utilized in the nonazide gas generant is preferably selected from compounds that maximize the nitrogen content of the fuel and regulate the carbon and hydrogen content thereof to moderate values. Such fuels are typically selected from azole compounds, particularly tetrazole compounds such as aminotetrazole, tetrazole, 5-nitrotetrazole, 5-nitroaminotetrazole, bitetrazole, and triazole compounds such as 1,2,4-triazole-5-one or 3-nitro-1,2,4-triazole-5-one. A preferred embodiment utilizes 5-aminotetrazole as the fuel because of cost, availability and safety.

Oxidizers generally supply all or most of the oxygen present in the system. The oxidizer actively supports combustion and further suppresses formation of CO. The relative amounts of oxidizer and fuel used is selected to provide a small excess of oxygen in the combustion products, thereby limiting the formation of CO by oxidizing the CO to carbon dioxide. The oxygen content in the combustion products should be in the range of 0.1% to about 5% and preferably from approximately 0.5% to 2%. The oxidizer is chosen from alkali metal nitrates, chlorates and perchlorates and alkaline earth metal nitrates, chlorates, and perchlorates. Strontium and barium nitrates are easy to obtain in the anhydrous state and are excellent oxidizers. Strontium nitrate and barium nitrate are most preferred because of the more easily filterable solid products formed, as described hereinbelow.

A slag former is included in the gas generant in order to facilitate the formation of solid particles that may then be filtered from the gas stream. A convenient method of incorporating a slag former into the gas generant is by utilizing an oxidizer or a fuel which also serves in a dual capacity as a slag former. The most preferred oxidizer which also enhances slag formation is strontium nitrate, but barium nitrate is also effective. Generally, slag formers may be selected from numerous compounds, including alkali, alkaline earth, and transition metal hydroxides, nitrates, chlorates, and perchlorates, as well as alkali metal silicates, borates, oxides, and carbonates, in addition to silicon dioxide, alkaline earth metal oxides, and naturally and synthetically manufactured magnesium and aluminum silicate compounds, such as clay and talc.

In accordance with the present invention, the built-in catalyst comprises an alkali metal salt, alkaline earth metal salt, or transition metal salt of tetrazoles, bitetrazoles and triazoles, or a transition metal oxide. The catalyst, which is mixed directly into the gas generating composition, promotes the conversion of CO and $NO_x$ to $CO_2$ and $N_2$. More specifically, metals, which are present in the form of a salt of a tetrazole, bitetrazole, or triazole, or in the form of a transitional metal oxide, catalyze two reactions. For example, a typical primary reaction is as follows:

$$2CO+2NO \rightarrow 2CO_2+N_2$$

It is also believed that the built-in catalyst also promotes a secondary decomposition reaction, as follows:

$$2NO \rightarrow N_2+O_2$$

The amount of catalyst which is included in the gas generating mixtures of the instant invention is preferably within a range of about 5% by weight to about 15% by weight of the gas generant mixture. Generally, the fuel is present in the gas generants of the present invention in a concentration of about 22% to about 50% by weight, the oxidizer is present in a concentration of about 30% to about 66% by weight, and the slag forming compound is present in a concentration of about 2% to about 10% by weight.

One skilled in the art will readily appreciate the manner in which the aforesaid combinations of ingredients are combined to form the gas generant compositions of the present invention. For example, the materials may be dry-blended and attrited in a ball-mill and then pelletized by compression molding. The present invention may be exemplified by the following representative examples wherein the components are quantified in weight percent.

EXAMPLE 1

A mixture of 5-aminotetrazole (5-AT) strontium nitrate [$Sr(NO_3)_2$], a copper salt of 5-AT, and clay is prepared having the following composition in percent by weight: 28.62% 5-AT, 57.38% $Sr(NO_3)_2$, 8.00% clay, and 6.00% of the copper salt of 5-AT.

The above materials are dry-blended, attrited in a ball-mill, and pelletized by compression molding.

EXAMPLE 2

A mixture of 5-AT, $Sr(NO_3)_2$, talc, and a zinc salt of 5-AT is prepared as described in Example 1 having the following composition in percent by weight: 28.62% 5-AT, 57.38% $Sr(NO_3)_2$, 6.00% talc, and 8.00% of the zinc salt of 5-AT.

EXAMPLE 3

A mixture of 5-AT, $Sr(NO_3)_2$, a copper oxide, and a copper salt of 5-AT is prepared as described in Example 1 having the following composition in percent by weight: 28.62% 5-AT, 57.38% $Sr(NO_3)_2$, 6.00% copper oxide, and 8.00% talc.

EXAMPLE 4

A mixture of 5-AT, $Sr(NO_3)_2$, a zinc oxide, and a copper salt of 5-AT is prepared as described in Example 1 having the following composition in percent by weight: 28.62% 5-AT, 57.38% $Sr(NO_3)_2$, 8.00% zinc oxide and 6.00% clay.

EXAMPLE 5

A mixture of 5-AT , $Sr(NO_3)_2$, a zinc oxide, and a zinc salt of 5-AT is prepared as described in Example 1 having the following composition in percent by weight: 28.62% 5-AT, 57.38% $Sr(NO_3)_2$, 6.00% zinc oxide and 8.00% talc.

While the preferred embodiment of the invention has been disclosed, it should be appreciated that the invention is susceptible of modification without departing from the scope of the following claims.

I claim:

1. A four-component nonazide gas generating composition that forms gases upon combustion useful for inflating a vehicle occupant safety restraint device comprising at least one material of each of the following functional groups of materials:

a. a fuel;

b. an oxidizer compound;

c. a slag forming compound; and d. a catalyst which promotes the conversion of toxic oxides of nitrogen and carbon monoxide to nitrogen gas ($N_2$) and carbon dioxide, respectively, wherein the fuel comprises 5-aminotetrazole which is present in a concentration of about 26% to about 32% by weight, said oxidizer compound comprises strontium nitrate which is present in a concentration of about 52% to about 58% by weight, said slag forming compound comprises clay which is present in a concentration of about 2% to about 10% by weight, and said catalyst comprises a zinc salt of 5-aminotetrazole, which is present in a concentration of about 5% to about 15% by weight.

2. A four-component nonazide gas generating composition that forms gases upon combustion useful for inflating a vehicle occupant safety restraint device comprising at least one material of each of the following functional groups of materials:

a. a fuel;

b. an oxidizer compound;

c. a slag forming compound; and d. a catalyst which promotes the conversion of toxic oxides of nitrogen and carbon monoxide to nitrogen gas ($N_2$) and carbon dioxide, respectively, wherein the fuel comprises 5-aminotetrazole which is present in a concentration of about 26% to about 32% by weight, said oxidizer compound comprises strontium nitrate which is present in a concentration of about 52% to about 58% by weight, said slag forming compound comprises talc which is present in a concentration of about 2% to about 10% by weight, and said catalyst comprises a copper salt of 5-aminotetrazole which is present in a concentration of about 5% to about 15% by weight.

3. A four-component nonazide gas generating composition that forms gases upon combustion Useful for inflating a vehicle occupant safety restraint device comprising at least one material of each of the following functional groups of materials:

a. a fuel;

b. an oxidizer compound;

c. a slag forming compound; and d. a catalyst Which promotes the conversion of toxic oxides of nitrogen and carbon monoxide to nitrogen gas ($N_2$) and carbon dioxide, respectively, wherein the fuel comprises 5-aminotetrazole which is present in a concentration of about 26% to 32% by weight, said oxidizer compound comprises strontium nitrate which is present in a concentration of about 52% to about 58% by weight, said slag forming compound comprises clay which is present in a concentration of about 2% to about 10% by weight, and said catalyst comprises a copper salt of 5-aminotetrazole which is present in a concentration of about 5% to about 15% by weight.

4. A four-component nonazide gas generating composition that forms gases upon combustion useful for inflating a vehicle occupant safety restraint device comprising at least one material of each of the following functional groups of materials:

a. a fuel;

b. an oxidizer compound;

c. a slag forming compound; and d. a catalyst which promotes the conversion of toxic oxides of nitrogen and carbon monoxide to nitrogen gas ($N_2$) and carbon dioxide, respectively, wherein the fuel comprises 5-aminotetrazole which is present in a concentration of about 26% to about 32% by weight, said oxidizer compound comprises strontium nitrate which is present in a concentration of about 52% to about 58% by weight, said slag forming compound comprises clay which is present in a concentration of about 2% to about 10% by weight, and said catalyst comprises a copper oxide which is present in a concentration of about 5% to about 15% by weight.

5. A four-component nonazide gas generating composition that forms gases upon combustion useful for inflating a vehicle occupant safety restraint device comprising at least one material of each of the following functional groups of materials:

a. a fuel;

b. an oxidizer compound;

c. a slag forming compound; and d. a catalyst which promotes the conversion of toxic oxides of nitrogen and carbon monoxide to nitrogen gas ($N_2$) and carbon dioxide, respectively, wherein the fuel comprises 5-aminotetrazole which is present in a concentration of about 26% to about 32% by weight, said oxidizer compound comprises strontium nitrate which is present in a concentration of about 52% to about 58% by weight, said slag forming compound comprises talc which is present in a concentration of about 2% to about 10% by weight, and said catalyst comprises a zinc oxide which is present in a concentration of about 5% to about 15% by weight.

* * * * *